US011471362B2

(12) United States Patent
Liang et al.

(10) Patent No.: US 11,471,362 B2
(45) Date of Patent: Oct. 18, 2022

(54) WALKER

(71) Applicant: Wistron Corp., New Taipei (TW)

(72) Inventors: Chen Yi Liang, New Taipei (TW); Cheng Hsing Liu, New Taipei (TW); Chien-Wei Chen, New Taipei (TW)

(73) Assignee: WISTRON CORP., New Taipei (TW)

( * ) Notice: Subject to any disclaimer, the term of this patent is extended or adjusted under 35 U.S.C. 154(b) by 80 days.

(21) Appl. No.: 16/935,151

(22) Filed: Jul. 21, 2020

(65) Prior Publication Data

US 2021/0290475 A1 Sep. 23, 2021

(30) Foreign Application Priority Data

Mar. 17, 2020 (TW) ..... 109108711

(51) Int. Cl.
*A61H 3/04* (2006.01)
*A61G 5/00* (2006.01)

(52) U.S. Cl.
CPC ..... *A61H 3/04* (2013.01); *A61G 5/00* (2013.01); *A61H 2003/043* (2013.01); *A61H 2201/0161* (2013.01)

(58) Field of Classification Search
CPC ..... A61H 3/04
See application file for complete search history.

(56) References Cited

U.S. PATENT DOCUMENTS

| | | | | |
|---|---|---|---|---|
| 5,348,336 | A | 9/1994 | Fernie et al. | |
| 9,849,057 | B1 * | 12/2017 | Janeczek | B60T 7/08 |
| 2015/0359699 | A1 | 12/2015 | Chang et al. | |
| 2019/0224058 | A1 | 7/2019 | Liang et al. | |
| 2020/0008990 | A1 * | 1/2020 | Harrison | B62K 5/025 |

FOREIGN PATENT DOCUMENTS

| | | | | |
|---|---|---|---|---|
| CN | 200973789 | Y | 11/2007 | |
| CN | 202859487 | U | 4/2013 | |
| CN | 104097724 | A | 10/2014 | |
| CN | 107789130 | A | 3/2018 | |
| DE | 3720368 | A1 * | 1/1989 | B62J 1/00 |
| JP | 2014-097222 | A | 5/2014 | |
| JP | 2019-058153 | A | 4/2019 | |
| KR | 10-1149604 | B1 | 6/2012 | |
| KR | 10-1219305 | B1 | 1/2013 | |
| TW | I657812 | B | 5/2019 | |
| TW | I678200 | B | 12/2019 | |
| WO | WO 2016/170364 | A1 | 10/2016 | |

* cited by examiner

*Primary Examiner* — David R Dunn
*Assistant Examiner* — Danielle Jackson

(57) ABSTRACT

A walker is provided. The walker includes a walker body, a handle unit, a first wheel unit and a second wheel unit. The handle unit is connected to the walker body. The first wheel unit is connected to the walker body. The second wheel unit is connected to the walker body. In an auxiliary mode, a first gap is formed between the first wheel unit and the second wheel unit. In a driving mode, a second gap is formed between the first wheel unit and the second wheel unit. The first gap is smaller than the second gap.

19 Claims, 10 Drawing Sheets

WALKER

CROSS REFERENCE TO RELATED APPLICATIONS

This Application claims priority of Taiwan Patent Application No. 109108711, filed on Mar. 17, 2020, the entirety of which is incorporated by reference herein.

BACKGROUND OF THE INVENTION

Field of the Invention

The present invention relates to a walker, and in particular to a walker providing an improved user experience.

Description of the Related Art

Conventional walkers have an auxiliary mode and a driving mode. In the auxiliary mode, the user can walk with the walker. In the driving mode, the user can ride on the walker, and the walker carries the user. However, in the auxiliary mode, the distance between the front wheel and the rear wheel should be decreased to reduce the turning radius. In the driving state, the distance between the front wheel and the rear wheel should be increased to improve stability when riding. The distance between the front wheel and the rear wheel of a conventional walker is fixed. The conventional walker therefore cannot provide better user experience.

BRIEF SUMMARY OF THE INVENTION

Embodiments of the invention are provided to address the aforementioned difficulty.

In one embodiment, a walker is provided. The walker includes a walker body, a handle unit, a first wheel unit and a second wheel unit. The handle unit is connected to the walker body. The first wheel unit is connected to the walker body. The second wheel unit is connected to the walker body. In an auxiliary mode, a first gap is formed between the first wheel unit and the second wheel unit. In a driving mode, a second gap is formed between the first wheel unit and the second wheel unit. The first gap is smaller than the second gap.

Utilizing the walker of the embodiment of the invention, the distance between the first wheel unit and the second wheel unit can be modified. In the auxiliary mode, the first distance between the first wheel unit and the second wheel unit is short, the turning radius of the walker is decreased, and the user can turn the direction of the walker with a shortened walking path. In the driving mode, the second distance between the first wheel unit and the second wheel unit is long, and the user can ride on the walker stably.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
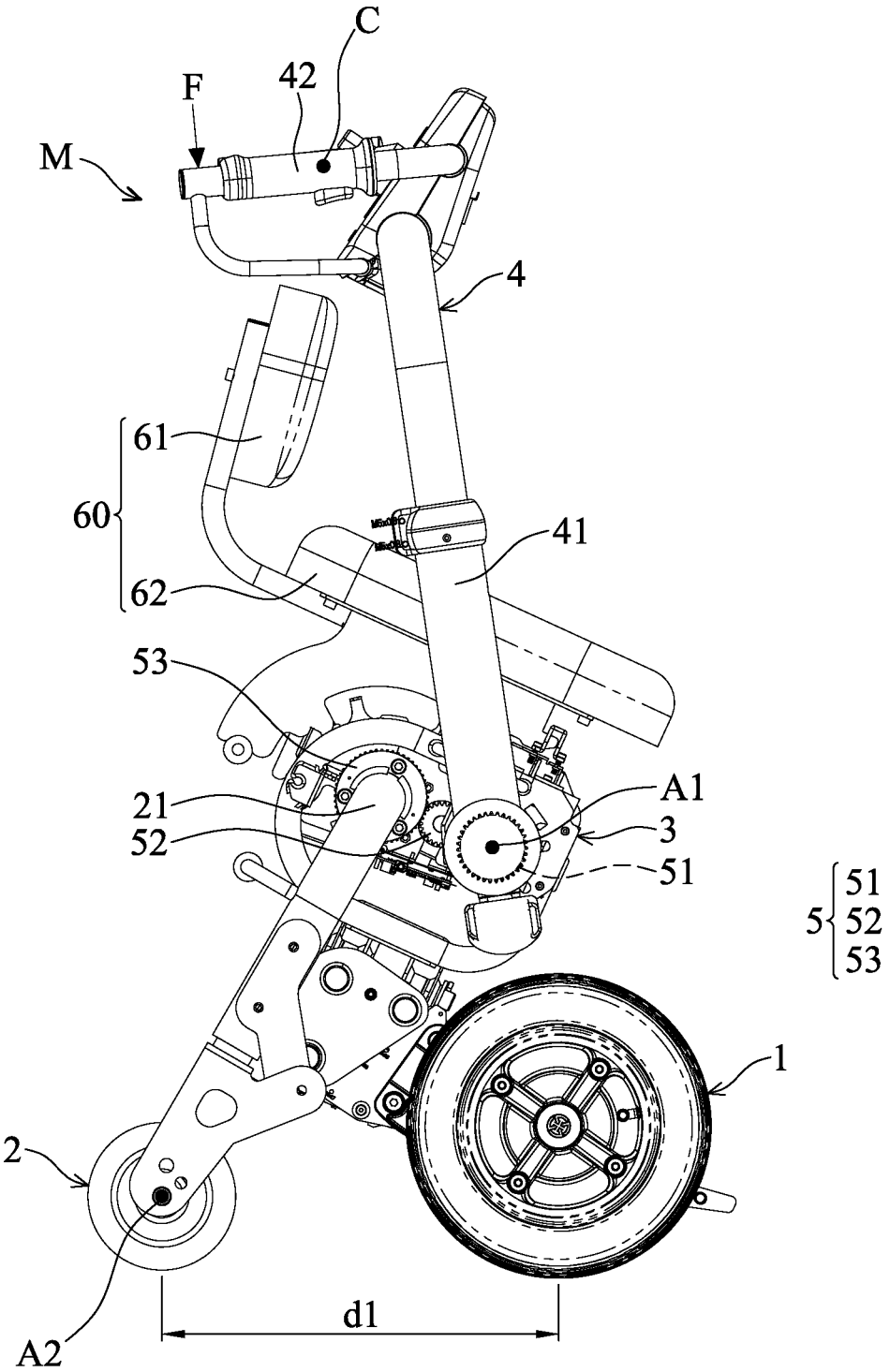
FIG. 1A shows a walker of the embodiment of the invention, wherein the walker is in an auxiliary mode.
Figure 1B:
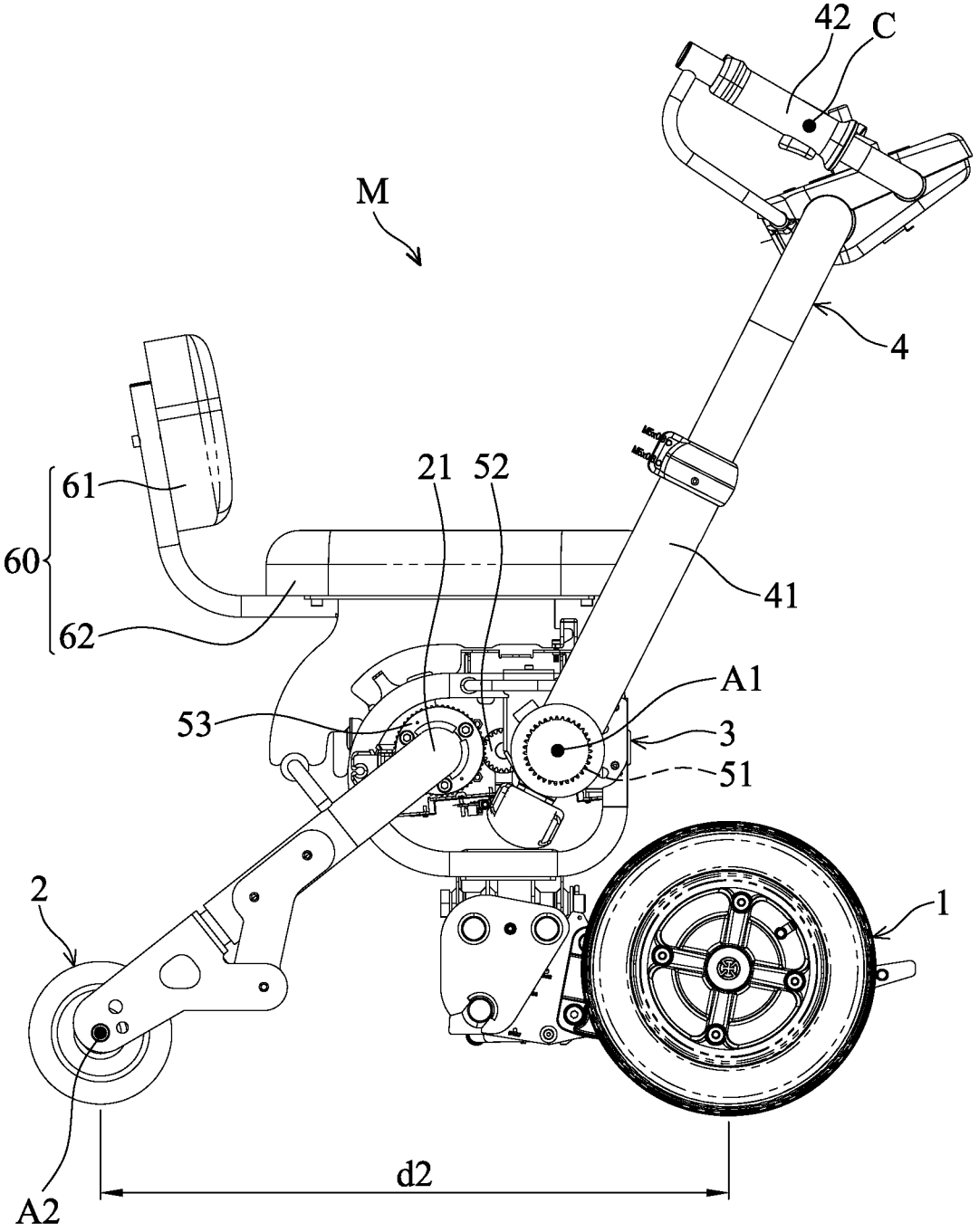
FIG. 1B shows the walker of the embodiment of the invention, wherein the walker is in a driving mode.

FIG. 1A shows a walker of the embodiment of the invention, wherein the walker is in an auxiliary mode. FIG. 1B shows the walker of the embodiment of the invention, wherein the walker is in a driving mode. With reference to FIGS. 1A and 1B, the walker M of the embodiment of the invention includes a walker body 3, a handle unit 4, a first wheel unit 1 and a second wheel unit 2. The handle unit 4 is connected to the walker body 3. The first wheel unit 1 is connected to the walker body 3. The second wheel unit 2 is connected to the walker body 3. In the auxiliary mode (FIG. 1A), a first gap d1 is formed between the first wheel unit 1 and the second wheel unit 2. In the driving mode (FIG. 1B), a second gap d2 is formed between the first wheel unit 1 and the second wheel unit 2, and the first gap d1 is smaller than the second gap d2.

With reference to FIGS. 1A and 1B, in one embodiment, the walker M further comprises a gear set 5. The gear set 5 is connected to the walker body 3. The handle unit 4 is connected to the gear set 5. The second wheel unit 2 is connected to the gear set 5. In one embodiment, in the auxiliary mode, when a pressing force F is applied to the handle unit 4, the pressing force F is transmitted to the gear set 5 and pushes the second wheel unit 2, and the second wheel unit 2 tends to move toward the first wheel unit 1.

With reference to FIGS. 1A and 1B, in one embodiment, the gear set 5 comprises a first gear 51, a second gear 52 and a third gear 53. The handle unit 4 comprises a handle linkage 41. The second wheel unit 2 comprises a wheel linkage 21. The handle linkage 41 is affixed to the first gear 51. The wheel linkage 21 is affixed to the third gear 53. The first gear 51 is meshed to the second gear 52. The second gear 52 is meshed to the third gear 53. In one embodiment, the handle unit 4 further comprises a grip 42. The grip 42 is connected to one end of the handle linkage 41. The first gear 51 is connected to the other end of the handle linkage 41. In one embodiment, the center C of the grip 42 is the center of gravity of the grip 42. In other words, the walker M is on a ground. In one embodiment, an axle of the first wheel unit 1 is on a plane, the plane is perpendicular to a ground. In the auxiliary mode, the grip 42 and the second wheel unit 2 is on the same side relative to the plane. In the driving mode, the grip 42 and the second wheel unit 2 are on different sides relative to the plane.

With reference to FIGS. 1A and 1B, in the auxiliary mode (FIG. 1A), the center C of the grip 42 is on the same side as the axle A2 of the second wheel unit 2 relative to an axle A1 of the first gear 51. In the driving mode (FIG. 1B), the center C of the grip 42 is on a different side than the axle A2 of the second wheel unit 2 relative to the axle A1 of the first gear 51.

As illustrated in FIGS. 1A and 1B, in one embodiment, the diameter of the first gear 51 is greater than the diameter of the second gear 52, and the diameter of the third gear 53 is greater than the diameter of the second gear 52. In the driving mode, the vertical height of the first gear 51 is equal to the vertical height of the third gear 53. In the auxiliary mode, the vertical height of the first gear 51 is lower than the vertical height of the third gear 53.

Figure 2A:
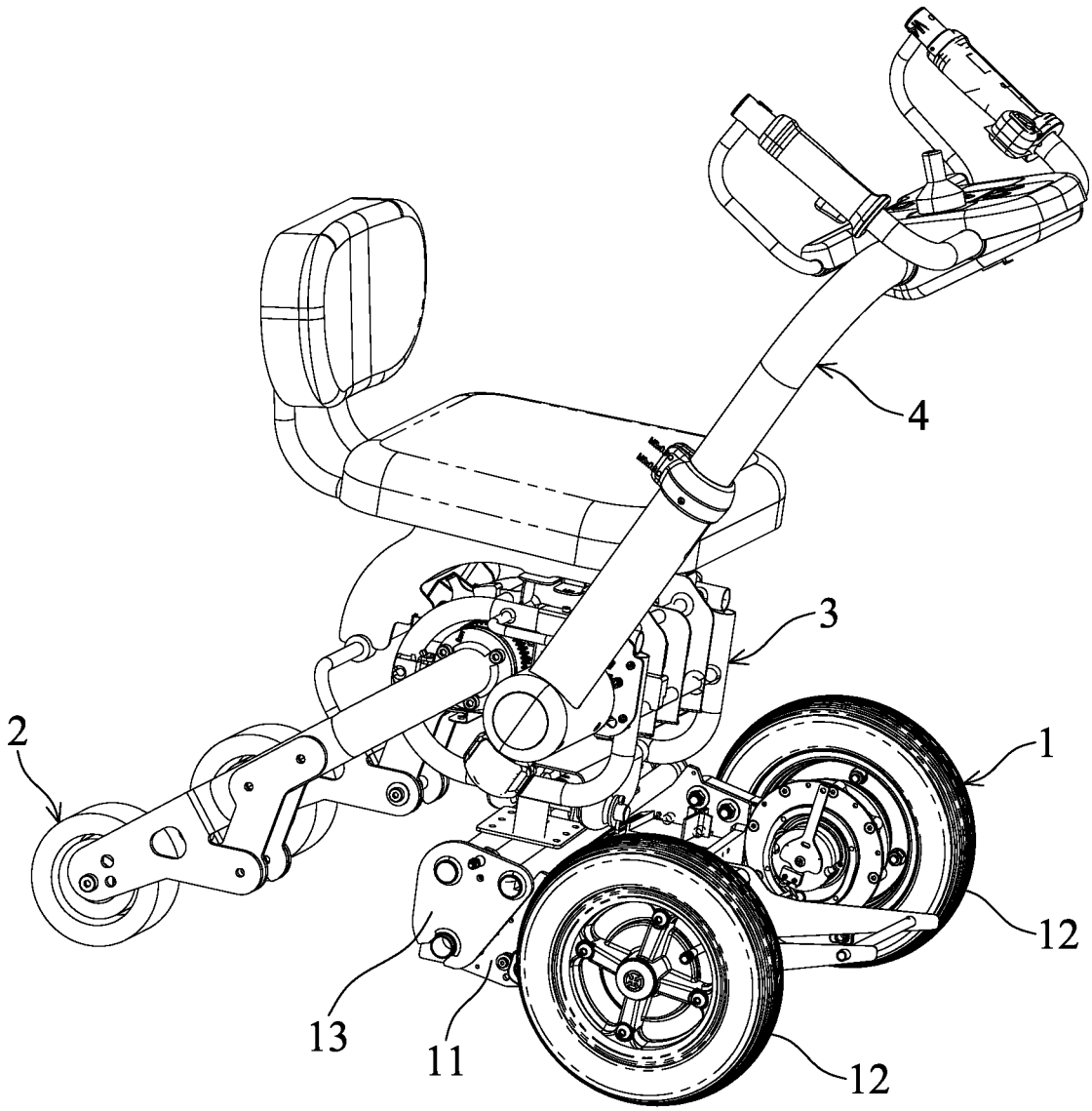
FIG. 2A is a perspective view of the walker of the embodiment of the invention.
Figure 2B:
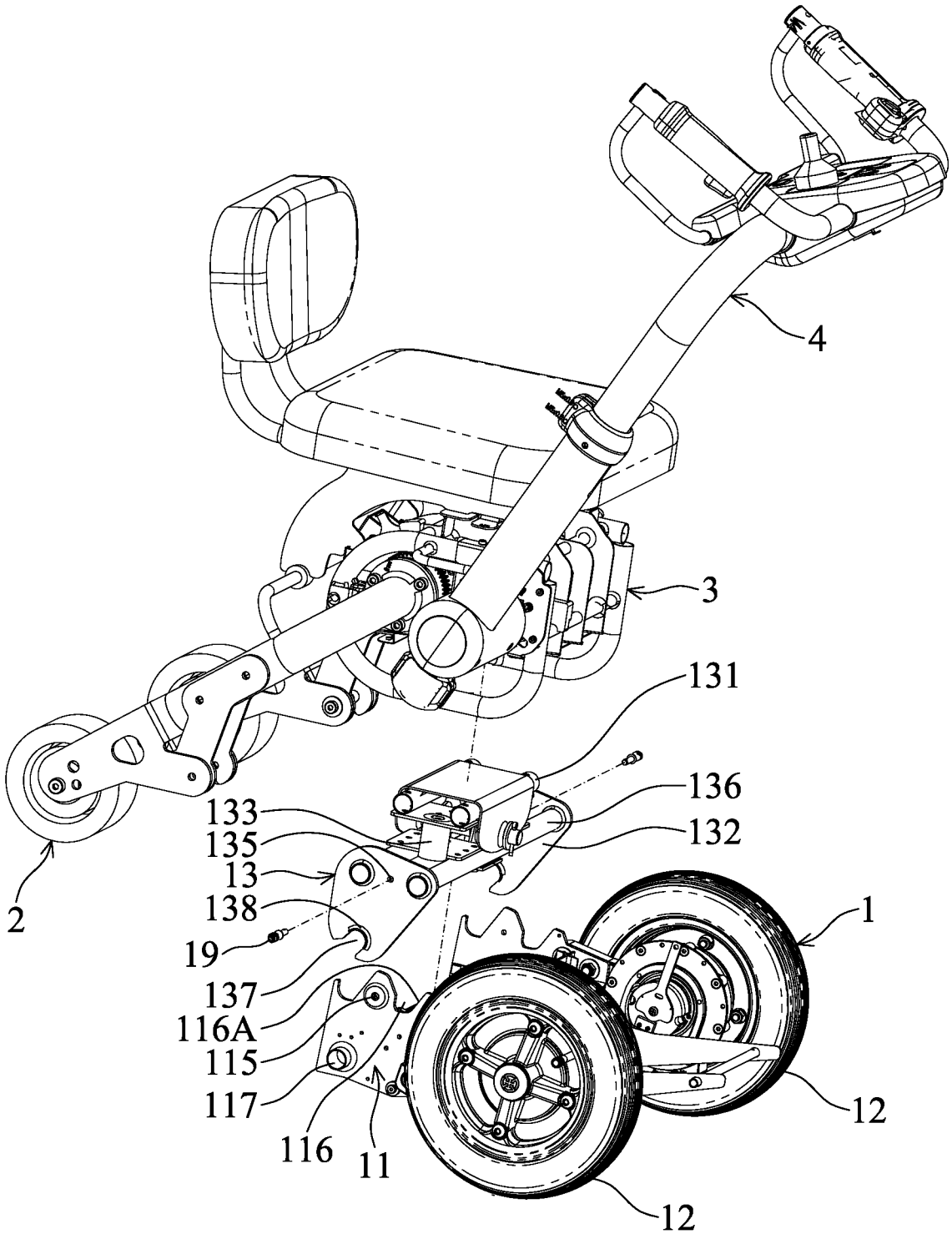
FIG. 2B is an exploded view of the walker of the embodiment of the invention.

FIG. 2A is a perspective view of the walker of the embodiment of the invention. FIG. 2B is an exploded view of the walker of the embodiment of the invention. With reference to FIGS. 2A and 2B, in one embodiment, the first wheel unit 1 comprises two first wheels 12, a wheel unit bracket 11 and a cushion module 13. The first wheels 12 are disposed on two sides of the wheel unit bracket 11. The cushion module 13 is disposed between the wheel unit bracket 11 and the walker body 3.

With reference to FIGS. 2A and 2B, in one embodiment, the wheel unit bracket 11 comprises a bracket notch 116. The cushion module 13 comprises a module rod 136. The module rod 136 is adapted to be wedged to the bracket notch 116. In one embodiment, the bracket notch 116 comprises a notch inclined surface 116A, and the module rod 136 is adapted to slide into the bracket notch 116 along the notch inclined surface 116A.

Figure 3A:
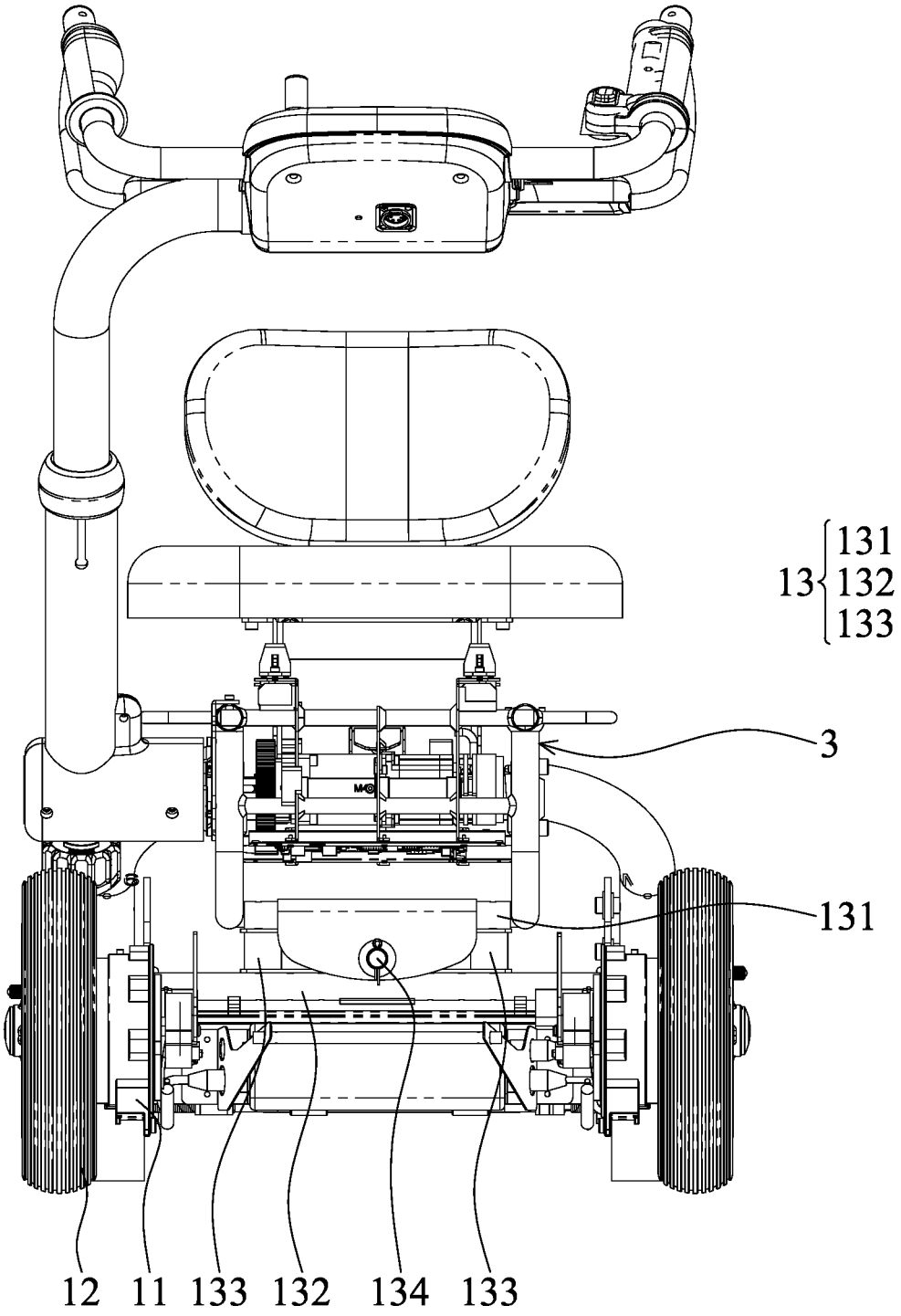
FIGS. 3A and 3B shows the operation of a cushion module of the embodiment of the invention.
Figure 3B:
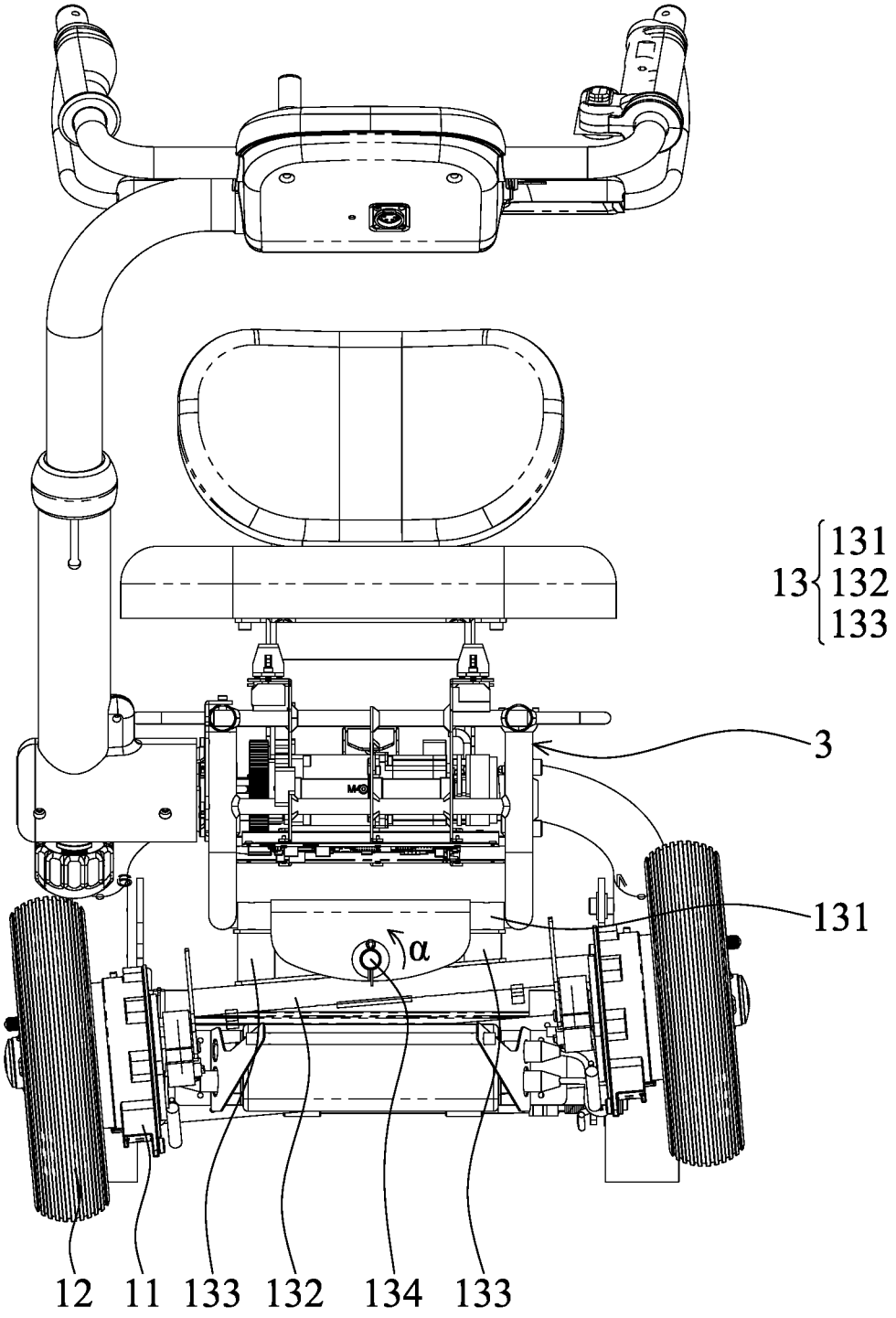

With reference to FIGS. 2A and 2B, in one embodiment, the wheel unit bracket 11 comprises a bracket post 117. The cushion module 13 comprises a module notch 137. The bracket post 117 is adapted to be wedged to the module notch 137. In one embodiment, the cushion module 13 comprises a module rib 138. The module rib 138 extends along at least a portion of an edge of the module notch 137, and the module rib 138 is adapted to abut the bracket post 117. FIGS. 3A and 3B shows the operation of the cushion module of the embodiment of the invention. With reference to FIGS. 3A and 3B, utilizing the cushion module 13, the wheel unit bracket 11 is adapted to be rotated in a rotational direction a relative to the walker body 3, and the rotational direction a is perpendicular to the moving direction of the walker M.

With reference to FIGS. 2B, 3A and 3B, in one embodiment, the cushion module 13 comprises a first connection bracket 131, a second connection bracket 132 and two cushion elements 133. The first connection bracket 131 is affixed to the walker body 3. The second connection bracket 132 is connected to the wheel unit bracket 11. The module rib 138 is connected to the bracket post 117. The module rod 136 is connected to the bracket notch 116. The second connection bracket 132 pivots on the first connection bracket 131 via a bracket pivoting portion 134. The cushion elements 133 are disposed between the first connection bracket 131 and the second connection bracket 132. The cushion elements 133 are disposed on two sides of the bracket pivoting portion 134. When the wheel unit bracket 11 is rotated in the rotational direction a relative to the walker body 3, the wheel unit bracket 11 applies to a pulling force to one cushion element 133 and applies a pushing force to the other cushion element 133.

In one embodiment, the first connection bracket 131 can be connected to the walker body 3 by welding or bolt. The cushion elements 133 can be disposed between the first connection bracket 131 and the second connection bracket 132 by welding or bolt. In one embodiment, the cushion elements 133 can also be directly disposed between the first connection bracket 131 and the second connection bracket 132, and are positioned by the friction provided by the material thereof.

In one embodiment, the walker is provided for the user with the ability of moving, disassembling and assembling the walker. The user can switch the walker into the driving mode for long distance movement. In the driving mode, the user can ride on the walker, and is moved comfortably. The user can switch the walker into the auxiliary mode for short distance movement. In the auxiliary mode, the user can stand and walk with the walker (for example, to play golf).

In one embodiment, the first wheel unit 1 can be separated from the cushion module 13, and the walker can be transmitted by car. With reference to FIGS. 2A and 2B, in one embodiment, the walker M further comprises a pin 19. The wheel unit bracket 11 is detachably connected to the cushion module 13. The wheel unit bracket 11 comprises a bracket connection hole 115. The cushion module 13 comprises a module connection hole 135. The pin 19 is adapted to pass through the bracket connection hole 115 and the module connection hole 135 simultaneously to connect the wheel unit bracket 11 and the cushion module 13.

Figure 4A:
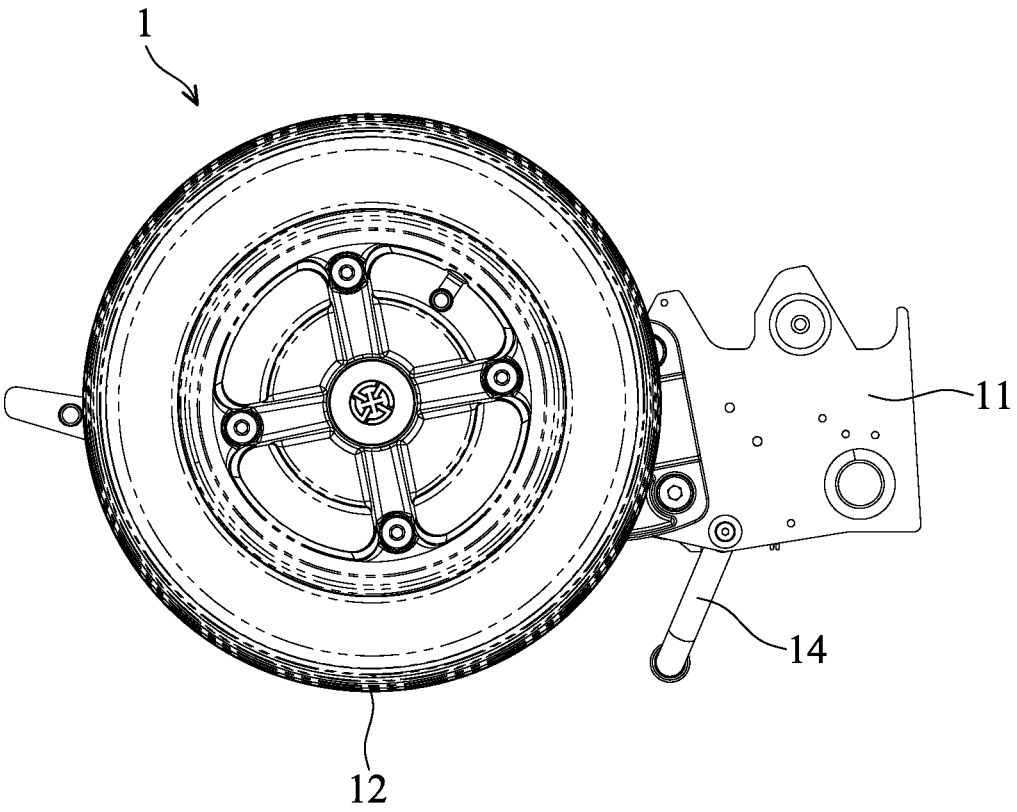
FIG. 4A shows the details of a first wheel unit of the embodiment of the invention, wherein a kickstand is in a first stand orientation.
Figure 4B:
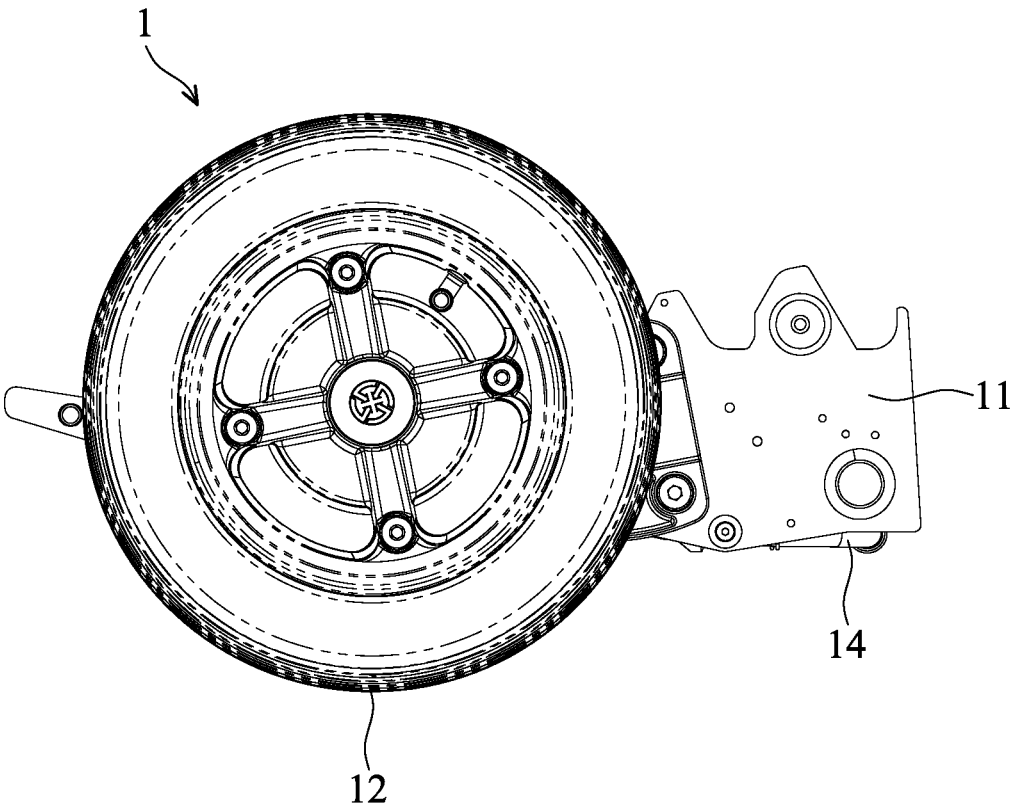
FIG. 4B shows the details of the first wheel unit of the embodiment of the invention, wherein the kickstand is in a second stand orientation.
Figure 4C:
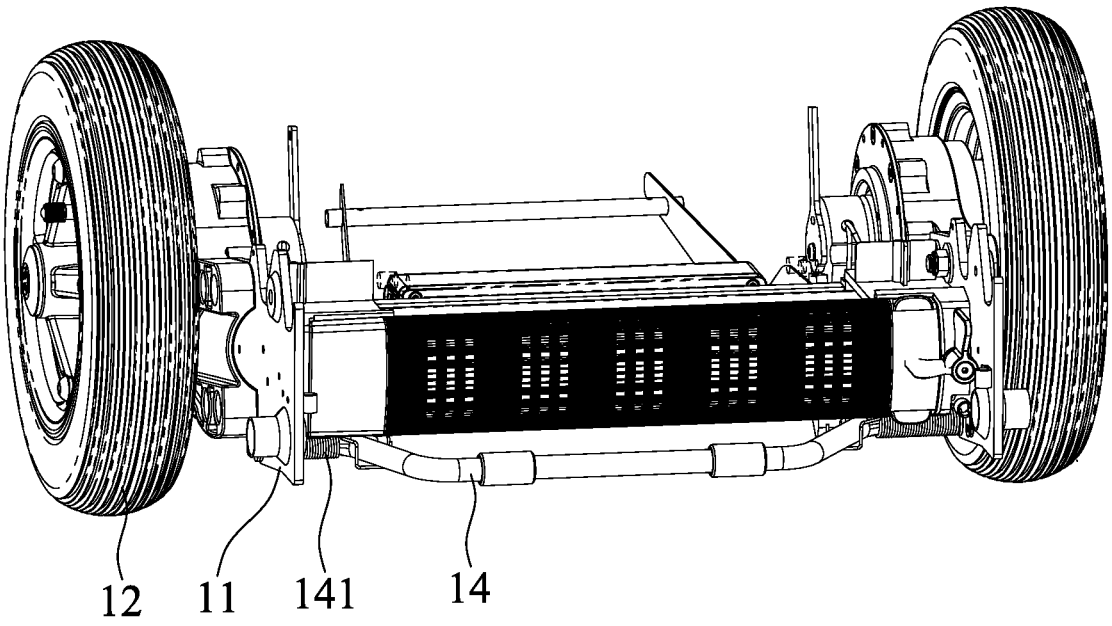
FIG. 4C shows the details of the first wheel unit of the embodiment of the invention.

FIGS. 4A, 4B and 4C show the details of the first wheel unit of the embodiment of the invention. With reference to FIGS. 4A, 4B and 4C, in one embodiment, the first wheel unit 1 further comprises a kickstand 14. The kickstand 14 is rotated between a first stand orientation (FIG. 4A) and a second stand orientation (FIG. 4B). When the kickstand 14 is in the first stand orientation (FIG. 4A), the kickstand 14 supports the wheel unit bracket 11. When the kickstand 14 is in the second stand orientation (FIG. 4B), the kickstand 14 is received in the wheel unit bracket 11. With reference to FIG. 4C, in one embodiment, the first wheel unit 1 further comprises an elastic element 141. One end of the elastic element 141 is connected to the kickstand 14, and the other end of the elastic element 141 is connected to the wheel unit bracket 11. The elastic element 141 helps the user to combine the wheel unit bracket 11 to the cushion module 13. First, the kickstand 14 can be rotated to the first stand orientation. Then, the pin 19 connects the wheel unit bracket 11 and the cushion module 13. Next, the kickstand 14 is rotated to the second stand orientation (via the elastic element 141).

Figure 5:
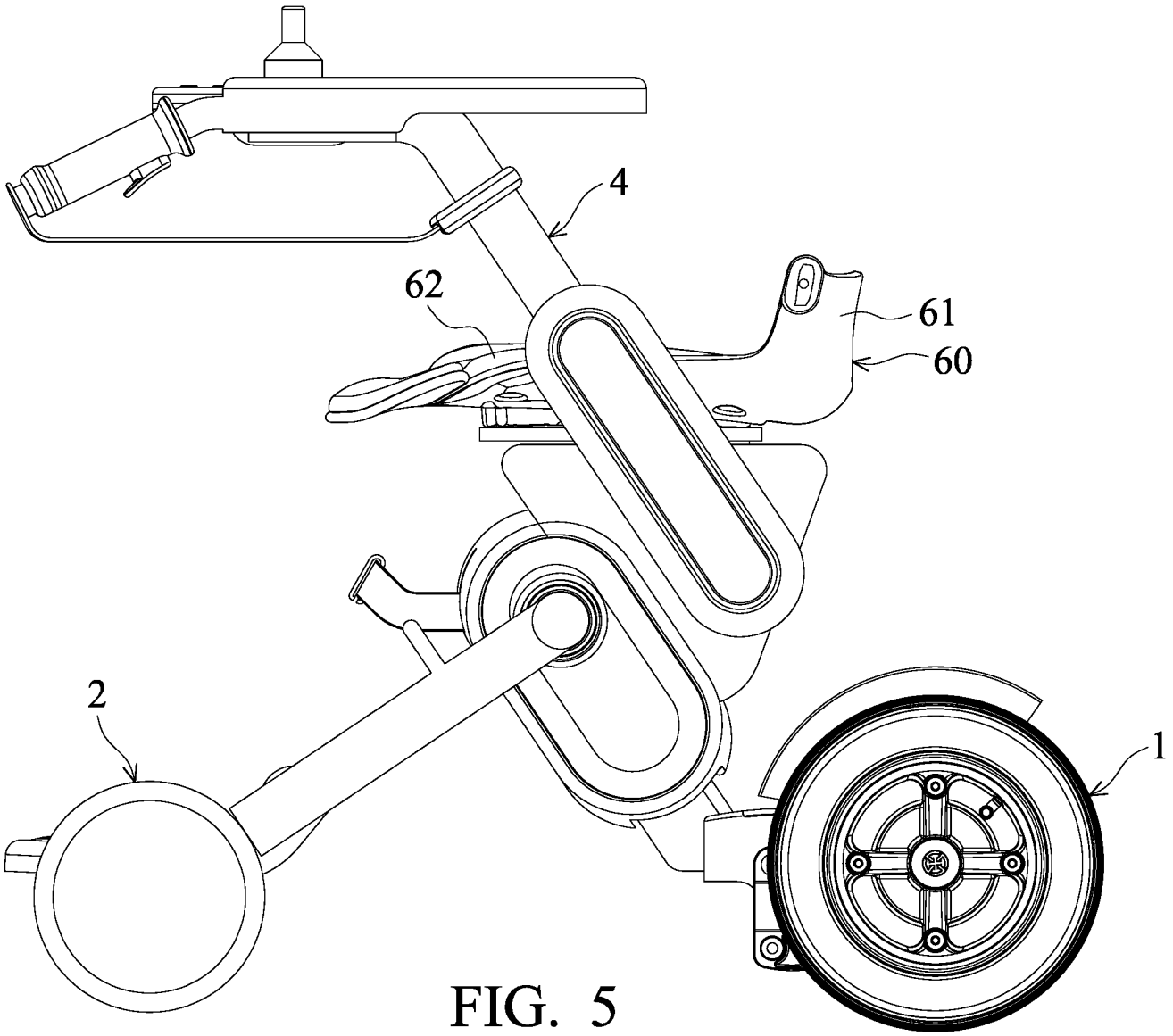
FIG. 5 shows another walker of the embodiment of the invention.

With reference to FIGS. 1A and 1B, in this embodiment, the walker M further comprises a chair 60. The chair 60 is disposed on the walker body 3. The chair 60 comprises a chair back 61 and a chair seat 62. The chair back 61 is connected to the chair seat 62. Relative to the first wheel unit 1, the chair back 61 is adjacent to the second wheel unit 2. However, the disclosure is not meant to restrict the invention. FIG. 5 shows another walker of the embodiment of the invention. With reference to FIG. 5, in another embodiment, relative to the second wheel unit 2, the chair back 61 is adjacent to the first wheel unit 1. Additionally, the extending direction of the handle unit 4 can be modified. The number and design of the handle linkage 41 and the grip 42 can also be modified.

Utilizing the walker of the embodiment of the invention, the distance between the first wheel unit and the second wheel unit can be modified. In the auxiliary mode, the first distance between the first wheel unit and the second wheel unit is shot, the turning radius of the walker is decreased, and the user can turn the direction of the walker with a shorter walking path. In the driving mode, the second distance between the first wheel unit and the second wheel unit is long, and the user can ride on the walker stably.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A walker, comprising:

a walker body;

a handle unit, connected to the walker body;

a first wheel unit, connected to the walker body;

a second wheel unit, connected to the walker body, wherein in an auxiliary mode, a first gap is formed between the first wheel unit and the second wheel unit, and in a driving mode, a second gap is formed between the first wheel unit and the second wheel unit, and the first gap is smaller than the second gap; and a gear set, wherein the gear set is connected to the walker body, the handle unit is directly connected to the gear set, and the second wheel unit is connected to the gear set, wherein the handle unit drives the gear set so that the second wheel unit tends to move toward the first wheel unit.

2. The walker as claimed in claim 1, wherein in the auxiliary mode, when a pressing force is applied to the handle unit, the pressing force is transmitted to the gear set and pushes the second wheel unit, and the second wheel unit tends to move toward the first wheel unit.

3. The walker as claimed in claim 2, wherein the gear set comprises a first gear, a second gear and a third gear, the handle unit comprises a handle linkage, the second wheel unit comprises a wheel linkage, the handle linkage is affixed to the first gear, the wheel linkage is affixed to the third gear, the first gear is meshed to the second gear, and the second gear is meshed to the third gear.

4. The walker as claimed in claim 3, wherein the handle unit further comprises a grip, the grip is connected to one end of the handle linkage, the first gear is connected to the other end of the handle linkage, wherein in the auxiliary mode, the center of the grip is on the same side as an axle of the second wheel unit relative to an axle of the first gear.

5. The walker as claimed in claim 4, wherein in the driving mode, the center of the grip is on a different side than the axle of the second wheel unit relative to the axle of the first gear.

6. The walker as claimed in claim 3, wherein a diameter of the first gear is greater than a diameter of the second gear, and a diameter of the third gear is greater than the diameter of the second gear.

7. The walker as claimed in claim 3, wherein in the driving mode, a vertical height of the first gear is equal to a vertical height of the third gear, and in the auxiliary mode, the vertical height of the first gear is lower than the vertical height of the third gear.

8. The walker as claimed in claim 1, further comprising a chair, wherein the chair is disposed on the walker body, the chair comprises a chair back and a chair seat, the chair back is connected to the chair seat, wherein relative to the first wheel unit, the chair back is adjacent to the second wheel unit.

9. The walker as claimed in claim 1, further comprising a chair, wherein the chair is disposed on the walker body, the chair comprises a chair back and a chair seat, the chair back is connected to the chair seat, wherein relative to the second wheel unit, the chair back is adjacent to the first wheel unit.

10. A walker, comprising:

a walker body;

a handle unit, connected to the walker body;

a first wheel unit, connected to the walker body; and a second wheel unit, connected to the walker body, wherein in an auxiliary mode, a first gap is formed between the first wheel unit and the second wheel unit, and in a driving mode, a second gap is formed between the first wheel unit and the second wheel unit, and the first gap is smaller than the second gap, wherein the first wheel unit comprises two first wheels, a wheel unit bracket, and a cushion module, and the first wheels are disposed on two sides of the wheel unit bracket, and the cushion module is disposed between the wheel unit bracket and the walker body, wherein the wheel unit bracket is adapted to be rotated in a rotational direction relative to the walker body via the cushion module, and the rotational direction is perpendicular to a movement direction of the walker.

11. The walker as claimed in claim 10, wherein the cushion module comprises a first connection bracket, a second connection bracket, and two cushion elements, and the first connection bracket is affixed to the walker body, the second connection bracket is connected to the wheel unit bracket, the second connection bracket pivots on the first connection bracket via a bracket pivoting portion, the cushion elements are disposed between the first connection bracket and the second connection bracket, the cushion elements are disposed on two sides of the bracket pivoting portion, and when the wheel unit bracket is rotated in the rotational direction relative to the walker body, the wheel unit bracket applies to a pulling force to one of the cushion elements and applies a pushing force to the other one of the cushion elements.

12. The walker as claimed in claim 10, further comprising a pin, wherein the wheel unit bracket is detachably connected to the cushion module, the wheel unit bracket comprises a bracket connection hole, the cushion module comprises a module connection hole, the pin is adapted to pass through the bracket connection hole and the module connection hole simultaneously to connect the wheel unit bracket and the cushion module.

13. The walker as claimed in claim 12, wherein the wheel unit bracket comprises a bracket notch, the cushion module comprises a module rod, and the module rod is adapted to be wedged to the bracket notch.

14. The walker as claimed in claim 13, wherein the bracket notch comprises a notch inclined surface, and the module rod slides into the bracket notch along the notch inclined surface.

15. The walker as claimed in claim 12, wherein the wheel unit bracket comprises a bracket post, the cushion module comprises a module notch, and the bracket post is adapted to be wedged to the module notch.

16. The walker as claimed in claim 15, wherein the cushion module comprises a module rib, the module rib extends along at least a portion of an edge of the module notch, and the module rib is adapted to abut the bracket post.

17. The walker as claimed in claim 10, wherein the first wheel unit further comprises a kickstand, the kickstand is rotated between a first stand orientation and a second stand orientation, and when the kickstand is in the first stand orientation, the kickstand supports the wheel unit bracket, and when the kickstand is in the second stand orientation, the kickstand is received in the wheel unit bracket.

18. The walker as claimed in claim 17, wherein the first wheel unit further comprises an elastic element, one end of the elastic element is connected to the kickstand, and the other end of the elastic element is connected to the wheel unit bracket.

19. The walker as claimed in claim 1, wherein an axle of the first wheel unit is on a plane, the plane is perpendicular to a ground, wherein in the auxiliary mode, the grip and the second wheel unit is on the same side relative to the plane, and in the driving mode, the grip and the second wheel unit are on different sides relative to the plane.

* * * * *